United States Patent [19]

Greenwood

[11] 4,428,638

[45] Jan. 31, 1984

[54] STRAIN RELIEF COMPONENT FOR ELECTRICAL CONNECTOR

[75] Inventor: William S. Greenwood, Nutley, N.J.

[73] Assignee: Thomas & Betts Corporation, Raritan, N.J.

[21] Appl. No.: 300,463

[22] Filed: Sep. 9, 1981

[51] Int. Cl.[3] ..... H01R 13/58

[52] U.S. Cl. ..... 339/107; 339/103 M

[58] Field of Search ..... 339/17 F, 103 R, 103 C, 339/103 M, 176 MF, 107

[56] References Cited

U.S. PATENT DOCUMENTS

| | | | |
|---|---|---|---|
| 2,951,112 | 8/1960 | Dahlgren | 174/135 |
| 3,090,028 | 5/1963 | Hall et al. | 339/174 |
| 3,601,768 | 8/1971 | Lightner | 339/103 |
| 3,737,833 | 6/1973 | Jerominek | 339/17 |
| 3,879,099 | 4/1975 | Shaffer | 339/99 |
| 4,080,038 | 3/1978 | Latta et al. | 339/103 M |
| 4,108,526 | 8/1978 | McKee | 339/103 |
| 4,139,727 | 2/1979 | Kuballa | 174/68.5 |
| 4,269,466 | 5/1981 | Huber | 339/107 |
| 4,323,295 | 4/1982 | Davis | 339/107 |
| 4,352,531 | 10/1982 | Gutter | 339/107 |

OTHER PUBLICATIONS

TRW Ribbon Connectors Catalog No. C-36, p. 5, Superibbon Wire Strain-Relief.

*Primary Examiner*—Joseph H. McGlynn
*Assistant Examiner*—David L. Pirlot
*Attorney, Agent, or Firm*—Robert M. Rodrick; Salvatore J. Abbruzzese

[57] ABSTRACT

A strain relief component for applying strain relieving forces to a multi-conductor flat cable at a location remote from that at which the individual ones of the cable conductors are connected to the electrical contacts of a termination connector, the strain relieving forces being applied with resilient members carried on cover parts fixedly connected to the termination connector.

11 Claims, 11 Drawing Figures

STRAIN RELIEF COMPONENT FOR ELECTRICAL CONNECTOR

FIELD OF THE INVENTION

The present invention is directed to a strain relief component particularly useful in an electrical connector adapted to receive a flat multi-conductor cable therein.

BACKGROUND OF THE INVENTION

It is customary to terminate multi-conductor cable, i.e., cable comprised of a plurality of discrete conductors with connectors, such connectors generally being referred to as either a plug or a receptacle. In either case, the connector is a body of insulative material having a plurality of conductor receptive channels therein, and an electrical contact disposed in each channel and to which respective individual ones of the conductors in the cable are electrically connected, as for example, by pressingly seating the conductor in the contact.

The introduction of flat multi-conductor cable which can be laid on a floor surface, covered with carpet tiles and used to power plugs and receptacles, has led to significant advantages in the physical construction and floor layout of commercial office buildings. In order to take full benefit of one of these advantages, the elimination of in-floor raceways or duct work which previously would have carried conventional power cable, it becomes desirable to also modify or replace other types of cables or wires which might have shared that duct work. Versions of such wire which could also be laid under carpet tiles would be the most desirable. One example would be the communication lines used for telephone, and for such purposes flat telephone cable is known. To terminate this flat cable, known types of connectors designed for and used with round cabled wire can be used. Termination to a known type of connector with flat conductor telephone cable presents no particular problem once the cable is stripped and the individual conductors are properly formed to be installed in the connector contacts. In fact, once cable preparation is complete, the typical flat telephone cable structure consisting of individual conductors placed at a fixed spacing and imbedded in a suitable encapsulating material should readily hold the prepared end so that installation in the connector would be easier than with other types of cable.

Regardless of the type of cable used, it is necessary to provide protection against the terminated conductors being dislodged from the contacts or broken by the manipulation of the completed cable assembly during installation procedures, or in other words to provide strain relief. Devices used to achieve this protection can either be separate restraining pieces or clamps, or they may be incorporated as a part of a hood or back shell used to cover the terminated connector. The prior art does not however provide for effecting strain relief in flat multiconductor cable at a location remote from the points where the conductors are connected with the contacts, with such strain relief being effected with resiliently yieldable strain relief force applying means adaptive to apply such force on flat cables of varying thicknesses.

SUMMARY OF THE PRESENT INVENTION

The present invention relates to a strain relief component which provides strain relief for flat multi-conductor cable at a location remote from points at which the individual ones of the conductors in such cable are electrically connected to the contacts of a connector, the strain relieving forces for the cable being effected wit resiliently yieldable force applying members to thereby render the component adaptive for use with cable of a range of thicknesses. The component also functions to shift the point of cable bending away from the contacts to such remote location where the cable possesses a full encapsulating protective covering. This is contrasted with locations intermediate this remote location and the contacts inasmuch as at such intermediate locations the full encapsulating covering has to be removed to facilitate making connection of the individual conductors therein with the electrical contacts of the connector.

The strain relief component of the invention also allows for effecting strain relief for the cable at a second location, i.e., at the points which the individual conductors are connected to the electrical contacts.

A further feature and object of the invention is to provide strain relief with a cover back shell which readily and conveniently can be assembled to a known type of connector to which flat multi-conductor cables can be terminated, the means with which strain relief is effected being at both aforementioned locations carried on and preferably being integral with the cover.

The present invention contemplates utilization of a flat cable termination with a connector typically of the SUPERRIBBON basic type, such connector being manufactured by TRW, Inc. of Elk Grove Village, Ill. This type of connector includes an elongated insulator body having a plurality of conductor receptive channels and a plurality of electrical contacts carried one in each of the channels, the contacts each being intended to have one of the cable conductors electrically connected thereto. In accordance with the invention, the strain relief component which can be fixedly secured to the cable connector in the form of a cover unit therefor is comprised of a pair of identically shaped cover parts each of which is receivable over one side of the connector to cooperate with the other to define the cover enclosure structure and effect cable strain relief when so assembled and fixed to the connector insulator body. Each cover part includes an elongatedly generally flat panel segment which when fixed to the connector generally overlies the contact carrying channels thereof. Each cover part also includes a resilient member generally elongated coextensive with the panel segment and extending laterally relatively thereof from adjacency therewith a distance in a course of convergence with cable, the resilient members each having elongated terminal edges which engage with the cable so that the cover parts when assembled have their resilient members engaging the cable at the opposite faces thereof and at a location remote from the connector contacts. At such remote location, the resilient members are in resiliently yieldable engagement with the cables and by reason of their resilient character, apply at such remote location oppositely directed strain-relieving bias forces to the cable. The nature of these forces can be appreciated from understanding that if there were no cable connected to the connector and the cover parts were to be fixedly connected thereto in complemental covering assembly, the terminal edges of the resilient members would juxtaposedly confront one another and be spaced in such confrontation a distance less than the predetermined thickness of the flat multi-conductor cables. Thus when the cover parts are received over the cable in intended manner, the resilient members to accomodate same must biasly yield outwardly of the cables in opposite directions, to the extent required by reason of the particular cable thickness. Such yielding and the resilient character of the said members produces counter-bias in the members and hence a strain relieving force application to the cable.

In preferred form, the resilient members follow a course of convergence with the cable which is of arcuate configuration, i.e., the lateral cross-section is arcuate with parallel inner and outer arcuate surfaces.

Side skirts are provided at opposite ends of each cover part with such skirt parts being disposed orthogonal to the flat panel segments enclosing the ends of the panel segments and resilient members, but being spaced a distance from the ends of resilient members since such members must be yieldable. The side skirts carry in each instance latching means components so that when the two cover parts are received fixedly on the connector insulator body, the skirts of one cover part align with those of the other part and can be latched together by means of the complemental latching means to define cover side walls.

The invention also provides that in addition to cable strain relief provided with the cover part resilient members, strain relief can also be provided at the contacts of the connectors with means embodied in the same cover structure. Each cover part is provided at the underside of its panel segment with a plurality of longitudinally spaced, transversely directed fingers which fingers when the cover parts are assembled to the connector insulator body, extend into the conductor receptive channels thereof to engage the conductors and provide strain relief thereto at the contacts to which they are connected.

Desirably, each of the cover parts is made as a single piece, molded plastic article in which the resilient members extend laterally from integral juncture with the panel members, and the side skirts are carried dependent from boss extensions of the panel members at the two ends thereof and located thereon adjacent the integral juncture of the panel members and their associated resilient members. Similarly, the dependent fingers extend integrally from the panel members, and parallel with but not necessarily below the means for fixedly connecting the panel members to the insulator body and which comprise a pair of fastener arms receivable in detent grooves of the connector insulator body, and made integral with and carried on the inner faces of the side skirts.

The invention accordingly comprises the strain relief having the features of construction, combination of elements and arrangements of parts which will be exemplified in the construction hereinafter set forth and the scope of the invention will be indicated in the claims.

BRIEF DESCRIPTION OF THE DRAWINGS

A fuller understanding of the nature and the objects of the present invention will be had from the following detailed description in conjunction with the accompanying drawings in which.

Throughout the description, like reference numerals are used to denote like parts in the drawings.

DESCRIPTION OF THE PREFERRED EMBODIMENT

Figure 1A:
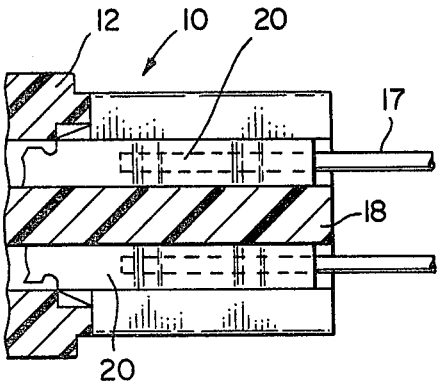
FIG. 1*a* is a fragmentary sectional view in elevation of the known type termination connector referred to earlier in the description and showing the manner in which the discrete conductors of a multi-conductor flat cable can be received in the contacts thereof.
Figure 1B:
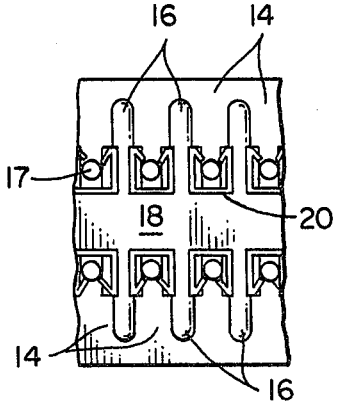
FIG. 1*b* is fragmentary end elevational view of FIG. 1*a* as viewed from the right side thereof.

With reference to FIGS. 1*a* and 1*b* there is shown therein a known type connector 10 comprising an insulator body 12 of a suitable plastic material providing insulative support for electrical contacts as will be discussed shortly. The insulator body 12 is of molded configuration and presents at the cable entry side thereof, a plurality of conductor receptive channels 14, the channels being defined by adjacent pairs of channel side walls 16, the arrangement being such that channels 14 are formed on both sides, e.g., top and bottom of an insulator body medial projector part 18 so that there is presented two distinct separate arrays of such channels in transversely directed longitudinally spaced arrangements. Deposed within each channel are electrical contacts 20, such contacts functioning in known manner to receive and embrace individual ones of the conductors of a multi-conductor flat cable (FIG. 2), the terminal end part of the cable having been prepared in known manner to expose such conductors, the conductors being held by the contacts in good electrical contact therewith. While it is not illustrated herein, those skilled in the art appreciate that the contacts have portions which extend leftwardly from the expanses thereof as depicted to the outer or front side of the connector wherein they constitute, e.g., in the instance of a female component or receptacle, the electrically conductive parts engaged by like contact parts on a male or plug receptacle.

As noted above, the various and plural ones of the cable conductors are electrically connected to the connector contacts and the strain relief component of the present invention is fitted onto the connector to serve the function of providing strain relief for the cable and functions further as a cover as it is conventional in the art to provide closure or cover means about the connector. The entry of the flat cable through the cover is best seen with reference to FIGS. 2 and 5.

Figure 2:
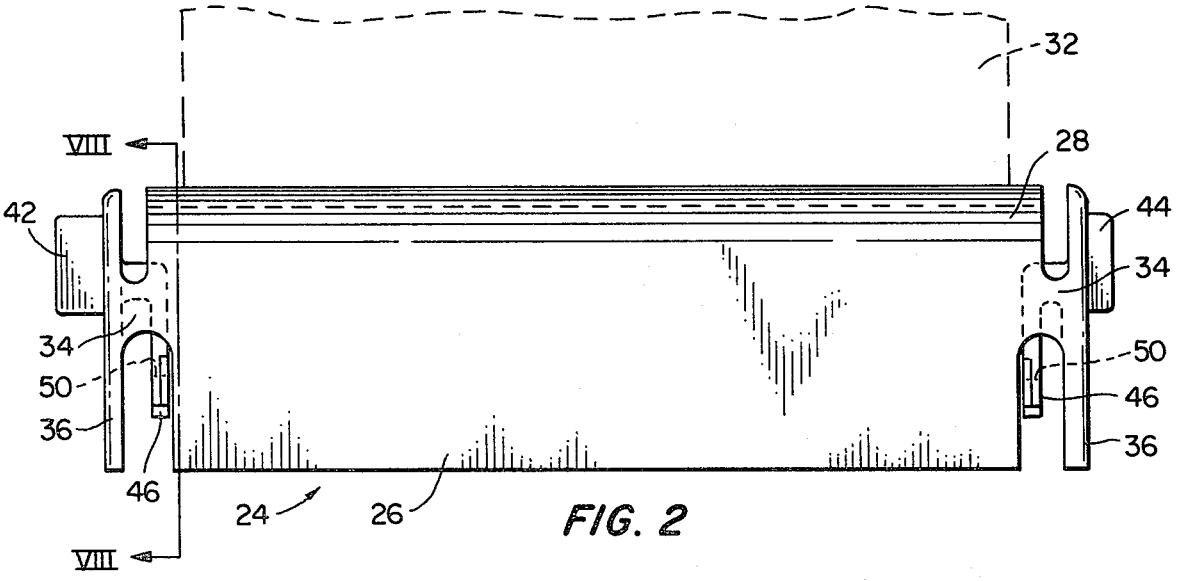
FIG. 2 is a top plan view, on enlarged scale of one of the strain relief component cover parts.
Figure 3:
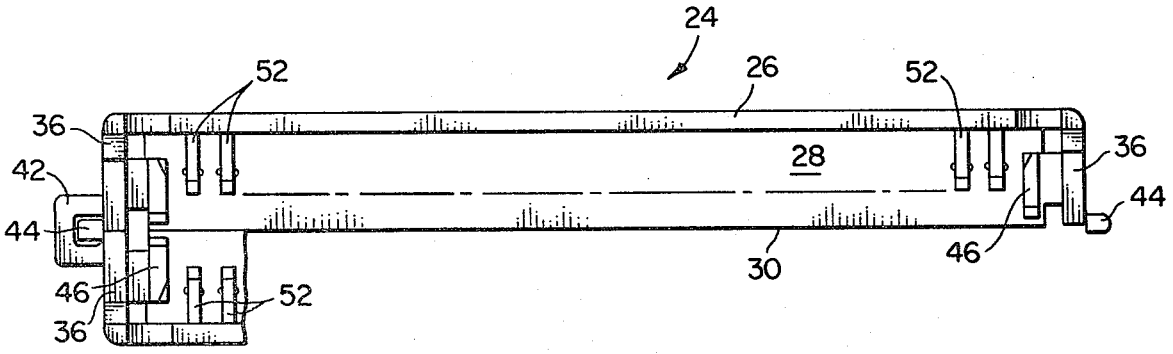
FIG. 3 is a rear elevational view of the cover part depicted in FIG. 2 and illustrating a fragmentary portion of a second like cover part which is employed with the first to define the strain relief component and a cover for the connector-cable assembly.
Figure 4:
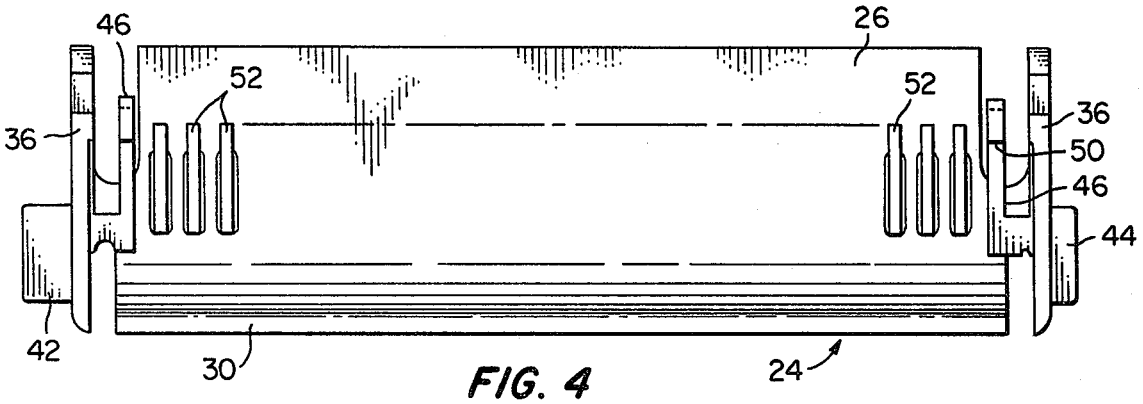
FIG. 4 is a bottom view of the cover shown in FIG. 2.
Figure 5:
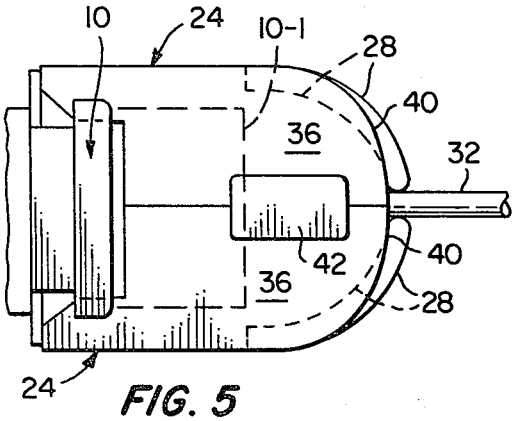
FIG. 5 is a side elevational view of the two assembled cover parts when received on the connector and with a flat cable having the discrete conductors thereof connected to the electrical contacts of the connector, the view showing how the resilient members of the cover parts grip the flat cable to apply strain relief bias thereto at a location remote from the connector contacts.
Figure 8:
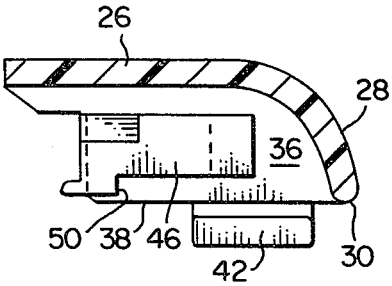
FIG. 8 is a sectional view as taken along the line VIII—VIII of FIG. 2.

Referring now to FIGS. 2–4, the strain relief component of the present invention comprises a pair of cover parts 24 which are of identical construction and configuration, the two cover parts when placed in opposed complemental disposition defining a cover over the two opposite broad sides of the connector. The cover parts are each preferably, though not essentially, formed as one-piece units having the structure thereon to be described shortly, the parts being readily and conveniently formed of plastic insulative type materials with known molding procedures. Each cover part 24 includes an elongated, generally flat panel segment 26 and a generally elongatedly coextensive resilient member 28 extending laterally from the flat panel segment and as seen in FIG. 8, e.g., curving downwardly to a terminal or tip edge 30 thereof, the said terminal tip edge when the two cover parts are assembled and mounted on the connector engaging one broad side face of the flat cable 32 in the manner as best shown in FIG. 5. At each of the two opposite ends of each panel segment, there are provided bosses 34 thereon which extend longitudinally of the panel segments and carry orthogonally disposed side skirts 36, the side skirts when the cover parts are assembled on the connector being aligned and defining side cover walls. The side skirts each have lower edges 38 (FIG. 8) which when the cover parts are assembled abut and as seen best in FIG. 5 the side skirts have an end edge 40 that follows a downwardly directed course generally similar to that of the outer surface of resilient members 28. The respective side skirts 36 of each cover part carry interengaging or complemental latch projections 42,44 which interengage to hold the cover parts connected together, the receptive mating of these projections being best seen in FIG. 3.

Figure 9:
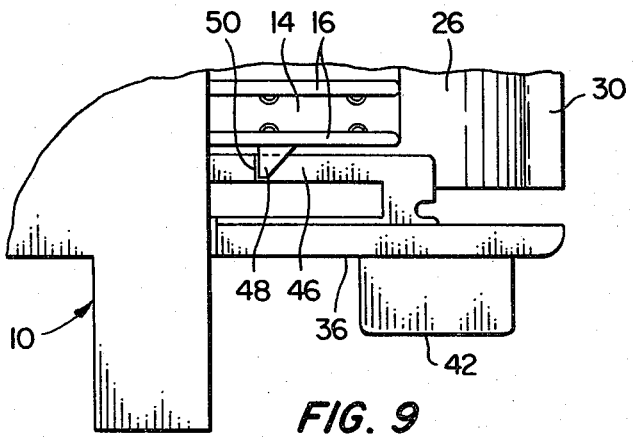
FIG. 9 is a fragmentary plan view depicting the manner in which the fastener arms function to fixedly secure the cover part panel members to the connector insulator body, such fastener arms biasly riding over and then locking behind cam lugs carried on the insulator body to effect such fixed connection.

Disposed at the inner surface of each side skirt 36 are elongated fastener arms 46 (FIGS. 3,4 and 8) which provide means to fixedly secure the panel segments and hence cover parts to the insulator body of the connector. FIG. 9 shows the manner in which the fastener arm which emerges from its associated side skirt inner surface and runs substantially parallel therewith locks behind a lug 48 formed on the connector, the fastener arm during assembly springing outwardly to ride over the lug until a retainer ledge 50 at the tip end of arm passes beyond the lug at which point the arm springs inwardly to lock the ledge behind the lug.

FIG. 5 illustrates the strain-relief component of the present invention mounted on or fixedly secured to the connector insulator body 10 and operative to provide strain relief for the cable 32 at a location remote from the contacts of the connector. The contacts of the connector, it will be appreciated, terminate along the vertical long and short dashed line 10-1 so that rightwardly from that point the cable 32 undergoes transition from a plurality of individual cable conductors which were stripped of their full protective encapsulation as a preliminary to making up the connection, to a condition wherein, and in advance to the location of the passage of the cable between resilient member terminal edges 30 the full protective covering on the cable is once again present. At such location, the resilient members have, as FIG. 5 shows, yielded outwardly relatively of the cable in opposition to the natural resiliency of the structure of member 28 in order to accomodate presence of the cable. Hence the resilient members exhibit as counter force to such yielding which results in application of strain-relieving force to the cable. In the preferred embodiment of the cover parts, the resilient members 28 have a course of convergence with the cable which is arcuate, i.e., the members have a transverse profile which is arcuate in shape (FIG. 8). Such course need not be arcuate as long as it follows the criteria of being convergent with the cable. Thus the profile of the members 23 could be linear but angled relative to the flat expanse of the associated panel segments.

Figure 6:
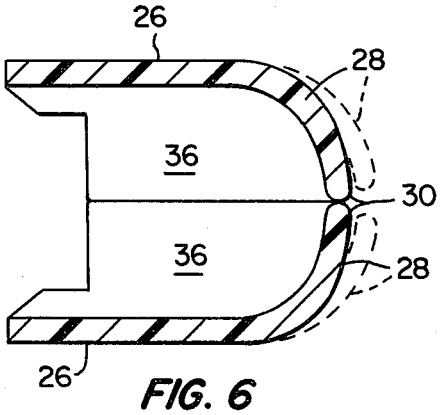
FIG. 6 shows in sectional fragmentary view how the terminal edges of the resilient members of the two cover parts would juxtapose if the cover parts were fixedly received on the connector and there were no cable extending between the said terminal edges, and the extent to which such members yield to accomodate passage of cable therebetween, the position to which the members yield being shown in phantom lines.

The extent to which the resilient members function to apply strain relief can be seen with reference to FIG. 6. If when the cover parts 24 were assembled together there were no cable of predetermined thickness extending between end edges 30, such edges 30 would be disposed in juxtaposed confrontation as shown in solid lines in FIG. 6 and be spaced at a distance less than such predetermined cable thickness and that spacing distance could be negligible where the edges 30 are in abutment. However, the presence of cable forces the resilient members 28 to yield to the position shown in phantom lines thereby producing a considerable strain relief force on the cable.

Figure 7:
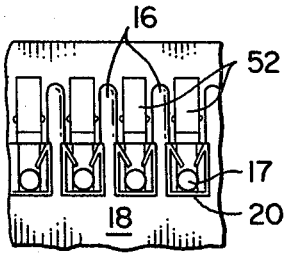
FIG. 7 is a fragmentary elevational view showing how the fingers of the panel members of the cover parts function to provide strain relief at a second location, i.e., at the contacts.

The invention also provides that strain relief can be applied to the cable at a second location different from said remote location, such second location being at the contacts of the connector. Thus as seen in FIGS. 3,4 and 7, the cover parts 24 each are provided at the underside of the panel segments, with a plurality of longitudingly spaced, laterally directed fingers 52 which, when the cover parts are assembled, extend into the conductor receptive channels 14 and engage the cable conductors 17 to maintain same securely in the contacts 20 in which they are received.

Figure 5A:
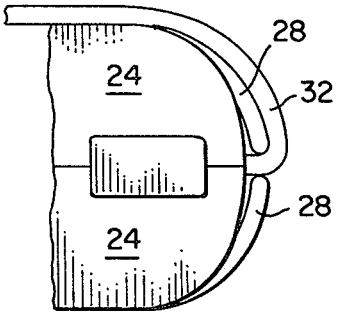
FIG. 5*a* shows the manner in which the strain relief further functions to move or shift the bending point of the cable from the region of the electrical contacts and lengths proximate thereto to a point where the full encapsulating covering of the cable is fully intact and thereby avoiding the possibility of individual conductor insulation damages or even nicks in the conductors themselves which may have occurred during preparation of the cable for termination in the connector and which can contribute to conductor failure under the influence of cable bending manipulations.

FIG. 5*a* shows the manner in which the strain relief component of the invention also provides the advantage of shifting the bending point at which the flat cable may during installation and/or use manipulation be bent in various ways. An extreme would be a substantially 180 turn formed in the cable as shown. Since, as discussed above, the preparation of the cable for connecting same to a connector can result in cutting or nicking of the individual conductor protective covering or of the conductors themselves, any bending at such locations where these breaks have occurred could result in breakage of the conductors if bent at those points. By moving the point at which the cable can be bent to the remote location at which strain relief is effected, conductor breakage is avoided.

Various modifications to the foregoing particularly described component will now be evident to those skilled in the art, and may be introduced without departing from the invention. Thus the foregoing preferred embodiment discussed and shown in the drawings is intended in an illustrative and not in a limiting sense. The true spirit and scope of the invention is set forth in the following claims.

What is claimed is:

1. For use with an electrical connector of the type receptive of flat cable having a plurality of conductors, said connector including an elongated insulator body having a plurality of conductor receptive channels and a plurality of electrical contacts carried one each in the respective ones of said channels for electrically connecting an associated one of the cable conductors therewith, a cable strain relief component fittable to said connector and comprising a pair of cover parts each having an elongated panel segment and embodying means for fixedly securing said panel segments to said insulator body at opposite sides of such body, said securing means holding said cover parts panel segments in disposition overlaying said channels and spaced therefrom;

resilient members carried on each of the respective cover parts and when said panel segments are fixedly secured to said insulator body extending into resiliently yieldable engagement with said cable on opposite side faces thereof at a location remote from said contacts and thereby applying at such remote location oppositely directed strain-relieving bias forces to the cable, and resilient members being substantially elongatedly coextensive with said panel segments and extending laterally relatively of said panel segments from a location of adjacency therewith in courses of convergence with and having termini at the opposite faces of said cable at said remote location;

cover part side skirts carried at opposite ends of the panel segments, the skirts of one part being alignable with those of the other part to define cover side walls othogonal to said panel segments, said side skirts of each cover part being fixed to the opposite ends of its panel segment and further extend alongside the respective opposite ends of the associated resilient member but spaced a distance therefrom; and complementary engageable latch means carried on the cover parts for latching such parts together to define a unitary enclosure structure.

2. The strain relief component of claim 1 in which said courses of convergence are arcuate.

3. The strain relief component of claim 1 in which the terminus of each said resilient member is defined by a rounded edge surface thereof.

4. The strain relief component of claim 1 in which the resilient member of each cover part is integral with its associated panel member.

5. The strain relief component of claim 1 in which the complementary engageable latch means are carried on the side skirts of said cover parts.

6. The strain relief component of claim 1 in which the side skirts have outer edge surfaces following couses similar to the convergence courses of said flexible members, the latch means being carried on said side skirts proximate the termini of said courses.

7. The strain relief component of claim 1 further comprising a plurality of fingers carried at the underside of each cover part panel segment and receivable when said panel segments are fixedly secured to said insulator body in said conductor channels for engageably contacting conductors connected to the contacts in said channels.

8. For use with an electrical connector of the type receptive of flat cable having a plurality of discrete conductors, said connector including an elongated insulator body having a plurality of conductor receptive channels and a plurality of electrical contacts carried one each in the respective ones of said channels for electrically connecting an associated one of the cable conductors therewith, a cover receivable on said connector and when so received applying strain relief to said flexible cable at two separate locations, said cover comprising a pair of cover parts each having an elongated panel segment and embodying means for fixedly securing said panel segments to said insulator body at opposite sides of said body in a disposition overlaying said channels and spaced therefrom, a plurality of fingers carried at the underside of each cover part panel segment and receivable in said connector channels for engageably contacting conductors connected to the contacts in said channel and thereby applying strain relief to said cable at a first location, and each cover part further having a resilient member extending laterally relatively of the associated panel segment from a location of adjacency therewith in a course of convergence with and having a terminus edge thereof resiliently yieldably engaging one of the opposite faces of said cable at a second location remote from the said first location, to thereby apply along with a resilient member of the other cover part at said second location oppositely directed strain-relieving bias forces to the cable;

cover part side skirts carried at opposite ends of the panel segments, the skirts of one part being alignable with those of the other part to define cover side walls othogonal to said panel segments, said side skirts of each cover part being fixed to the opposite ends of its panel segment and extending alongside the respective opposite ends of the associated resilient member spaced at a distance therefrom.

9. The cover of claim 8 in which each cover part is provided at opposite ends thereof with latching means carried on said side skirts and engageable with latching means carried on the side skirts of the other cover part for fixedly connecting the cover parts togetner as a unitary structure.

10. The cover of claim 8 in which the resilient member of each cover part is substantially elongatedly coextensive with its associated panel segment and in its lateral extent therefrom follows an arcuate course to convergent engagement with said cable.

11. The cover of claim 10 in which the panel segment and resilient member of each cover part are integral and of substantially uniform thickness.

* * * * *